US009463136B2

(12) United States Patent
Cohen

(10) Patent No.: US 9,463,136 B2
(45) Date of Patent: Oct. 11, 2016

(54) HEATABLE MASSAGE ROLLER AND POSTURE AID

(71) Applicant: Michael A Cohen, Toronto (CA)

(72) Inventor: Michael A Cohen, Toronto (CA)

( * ) Notice: Subject to any disclaimer, the term of this patent is extended or adjusted under 35 U.S.C. 154(b) by 657 days.

(21) Appl. No.: 13/713,203

(22) Filed: Dec. 13, 2012

(65) Prior Publication Data

US 2013/0184620 A1 Jul. 18, 2013

Related U.S. Application Data

(60) Provisional application No. 61/630,676, filed on Dec. 16, 2011, provisional application No. 61/596,446, filed on Feb. 8, 2012.

(51) Int. Cl.
*A61H 15/00* (2006.01)
*A61H 15/02* (2006.01)

(52) U.S. Cl.
CPC ..... *A61H 15/0092* (2013.01); *A61H 15/02* (2013.01); *A61H 2015/0014* (2013.01); *A61H 2201/0111* (2013.01); *A61H 2201/0157* (2013.01); *A61H 2201/0257* (2013.01); *A61H 2201/1284* (2013.01); *A61H 2201/168* (2013.01); *A61H 2201/1623* (2013.01); *A61H 2201/1645* (2013.01); *A61H 2201/1695* (2013.01); *A61H 2203/0431* (2013.01); *A61H 2205/081* (2013.01)

(58) Field of Classification Search
CPC ..... A61H 15/02; A61H 15/0092; A61H 2015/0014; A61H 2015/0021; A61H 2201/1623; A61H 2201/1284; A61H 2201/0111; A61H 2201/168; A61H 2205/081; A61H 2201/1645; A61H 2015/0042; A61H 15/00; A61H 2201/1695
USPC ..... D24/200, 211
See application file for complete search history.

(56) References Cited

U.S. PATENT DOCUMENTS

| | | | | |
|---|---|---|---|---|
| 3,750,654 | A * | 8/1973 | Shiu | 601/121 |
| 4,378,007 | A * | 3/1983 | Kachadourian | 601/121 |
| 4,832,006 | A * | 5/1989 | Kirsch | 601/122 |
| 4,884,560 | A * | 12/1989 | Kuracina | 601/19 |
| 5,575,760 | A * | 11/1996 | Masuda | 601/19 |
| 6,419,650 | B1 * | 7/2002 | Ryan et al. | 601/122 |
| 6,974,427 | B1 * | 12/2005 | Lapham | 601/120 |
| D674,107 | S * | 1/2013 | Prudent et al. | D24/211 |
| 2004/0249322 | A1 * | 12/2004 | Cohen | 601/131 |

* cited by examiner

*Primary Examiner* — Justine Yu
*Assistant Examiner* — Douglas Sul
(74) *Attorney, Agent, or Firm* — Colin P. Abrahams

(57) ABSTRACT

A massage roller has a central spinal recess portion, a circular wall portion on each side of the spinal recess portion, and an outer portion extending outwardly from each of the circular wall portions, the outer portion having a first diameter at or near the circular wall portion, and a second diameter remote from the circular wall portion, the second diameter being larger than the first diameter.

11 Claims, 8 Drawing Sheets

HEATABLE MASSAGE ROLLER AND POSTURE AID

CROSS REFERENCE TO RELATED APPLICATIONS

This application claims the benefit of Provisional Patent Application No. 61/630,676 filed Dec. 16, 2011 and Provisional Patent Application No. 61/596,446 filed Feb. 8, 2012, both of which applications are incorporated herein by reference in their entirety.

FIELD AND BACKGROUND OF THE INVENTION

This invention relates to a massage roller and posture aid which may be used in treating various human conditions. More particularly, the massage roller is used as a massage apparatus, and has as one of its possible uses the facilitation of muscle relief and tension, as well as potential reduction of pain in the back, neck, shoulder, hip, legs, feet, or such other part of the body, of a person being treated.

SUMMARY OF THE INVENTION

According to one aspect of the invention, there is provided a massage roller comprising: a central spinal recess portion; a circular wall portion on each side of the spinal recess portion; and an outer portion extending outwardly from each of the circular wall portions, the outer portion having a first diameter at or near the circular wall portion, and a second diameter remote from the circular wall portion, the second diameter being larger than the first diameter.

Preferably, the diameter of the central spinal recess portion is substantially the same as the first diameter of the outer portion. In one embodiment, the circular wall portion comprises a wider base portion tapering towards a rounded top portion. The circular wall portion may comprise a series of contoured humps along at least a portion thereof. Further, a series of linearly arranged protrusions or ribs may be formed along at least a portion thereof.

Preferably, the outer portion comprises a plurality of protrusions or ribs on the surface thereof. The protrusions may be arranged linearly in a circumferential manner around the outer portion.

In one embodiment, the massage roller may comprise a hollow cavity formed therein, the hollow cavity having an outlet channel and a plug for selectively sealing and opening access to the hollow cavity.

Fill material may be located in the hollow cavity. Larger protrusions may be formed on the outer surface of the outer portion near the circular wall and smaller protrusions may be formed on the outer surface of the outer portion away from the circular wall.

According to another aspect of the invention, there is provided a method of applying therapeutic pressure to the back of a user, the method comprising applying a massage roller having a central spinal recess portion for accommodating the spinal area of the user, providing a circular wall portion on each side of the spinal recess portion for rolling over the area adjacent the spine of the user, and applying an outer portion of the massage roller to the back, the outer portion extending outwardly from each of the circular wall portions, the outer portion having a first diameter at or near the circular wall portion, and a second diameter remote from the circular wall portion, the second diameter being larger than the first diameter.

According to one aspect of the invention, there is provided a massage roller comprising: an outer surface having a plurality of projections thereon; and an inner portion comprising a material selected for its ability to retain heat.

Preferably, the outer surface has one portion thereof which has a plurality of projections having a first size, and another portion having a plurality of projections thereon having a second size. At least one of the projections may comprise a base portion on the outer surface of the massage roller, and a shaped portion mounted on the base portion.

In one form, the massage roller further comprises at least one projection on the outer surface of the massage roller having a third size. The invention is not limited to a massage roller with projections of three sizes, and any number of convenient size projections may be provided in various configurations.

Preferably, the inner portion comprises a cavity, at least a part of which may contain material selected for its ability to retain heat. The inner portion may comprise a plurality of cavities formed beneath the outer surface, at least one of the plurality of cavities having a portion thereof which contains the material selected for its ability to retain heat. Some or all of the cavities may be in communication with each other, or each cavity may be a discrete one unconnected to the others. The cavities may have closable access points so that desired materials may be placed in or removed from the cavities.

The material selected for its ability to retain heat may be comprised wholly or partially of air. The material selected for its ability to retain heat may also comprise a mixture of silica and flax seed. The silica and flax seed may be present in relative proportions representing 50%-85% of the total, preferably about 25% silica and about 75% flax seed. The invention is not limited to such proportions, or even such materials.

According to another aspect of the invention, there is provided a method of forming a massage roller for massage, the method comprising the steps of: forming a plurality of projections on an outer surface of the massage roller; locating a material selected for its ability to retain heat below the outer surface of the massage roller; and providing heat to the material selected for its ability to retain heat.

According to yet a further aspect of the invention, there is provided a massage roller comprising: a massage application portion having an outer surface and a plurality of projections thereon; and a base portion upon which the massage application portion is mounted. Preferably, the therapeutic massage device further comprises an inner portion comprising a material selected for its ability to retain heat. The massage application portion may be of substantially hemispherical shape.

In general, the massage roller of the invention is utilized in one type of application by applying the massage roller to a specific area being treated, or laying the body part in need of muscle, or other treatment, on or against the massage roller.

An important aspect of the massage roller comprises a plurality of projections or nib-like extensions formed on the outer surface of the massage roller, the projections being shaped and configured for optimal effect.

A further aspect of the massage roller is a circumferential region around or near the mid-section of the massage roller which accommodates the spinous processes of a user's vertebrae.

Another important aspect of the invention relates to the fact that the core, center or other portion of the massage roller are filled with, or contain, a substance and/or material which is able to retain heat for a period of time after it has been heated, so that the retained heat remains present for a period of time in order that at least a portion of the massage or application of the massage roller occurs with the retained heat. The massage roller is heated, preferably by boiling it or by placing it in a microwave oven, prior to use, and the heated massage roller together with the optimally configured projections and/or circumferential belt area thereon has been found to provide an advantageous benefit by relieving muscular and/or skeletal tension and/or pain.

Preferably, the projections or pointed nibs on the surface of the massage roller, and the heat and pressure therefrom, have been found to produce an acupressure-like effect in the tissue on which it is being worked and a releasing effect on the adjacent skeletal structures. Several beneficial effects have been found as a result of this combination. First, the massaging effect of the massage roller, using pressure and heat, is likely to increase blood flow to the area at which it is applied, which may have the effect of flushing out built-up waste products that may have accumulated in tight muscle tissues over time.

Another potential effect relates to the decrease in central nervous system irritability which may follow the relaxation of tight muscle segments, and opening between adjacent vertebrae and between the skull and vertebrae, which may be locked in spasm or habitually tightened states. The massage roller has an area which allows the spinous processes of the vertebrae to fit into the massage roller while adjacent paraspinal muscles may receive an acupressure like effect from the massage roller's projections. This may create an intersegmental vertebral and occipito-vertebral loosening effect which may in turn decrease joint irritation and the concomitant central nervous system irritation which follows this.

In one important aspect of the invention, the surface of the massage roller has projections thereon which are of different sizes and configurations.

Another important aspect of the invention is that a hollowed-out interior of the massage roller is filled with a substance, mixture or composition which can be heated, preferably in a microwave oven or by boiling, and will retain the heat for significant or longer periods of time while the massage roller is used for massaging. While many different types of fill material can be used, it has been found that a mixture of water and a boiling point heightener substance provides a good fill material for the present purposes. In another preferred embodiment, a mixture of about 25% silica and about 75% flaxseed may be used, although the relative proportions of these two components may vary so that each may be present in a small amount, such as about 5%, to significantly more amounts which could exceed 50-85% or more of the total. Further, the fill material may be air.

According to one aspect of the invention, there is provided a heatable cylindric massager with a central groove for receiving or accommodating the spine of a person, and which creates optimum upright sitting posture when placed behind the back of the person when sitting in a chair.

The invention includes the following two features or characteristics:

(1) It may comprise a self-treatment device which enables users to release their own tight muscles, connective tissue and spinal joints relieving pain, stiffness and degenerative spinal states while improving flexibility and performance.

(2) It may comprise a postural aid to correct common forward slouching while using a computer.

When placed behind the back of a person in a chair while seated, the device of the invention recreates or assists in achieving the natural lower spinal curvature (lordotic curve) resulting in markedly more upright posture significantly decreasing negative forward slouching effects on muscles, joints, organ systems and spinal discs. Decreased pain and improved productivity may result from this.

The build up of muscle waste and contracted tissue may be released as the device of the invention provides acupressure points and heat increases the blood flow and physically loosens contracted muscle, connective tissue and joints resulting in decreased pain, improved mobility and enhanced athletic performance. An overall relaxation effect may occur, sometimes within three minutes of using the device of the invention, as pain is relieved, muscular and connective tissue and joint tightness releases, and natural pain killers and sedatives may be released from the central nervous system and the heating effect soothes the individual.

The massage roller of the invention has certain features, which may be set forth as follows:

(1) A spinal align belt (which may also be described as a circumferential central recessed groove) accepts or accommodates vertebral processes while bilateral acupressure rings penetrate and loosen paraspinal muscles enhancing spinal and muscular mobility.

(2) Bilateral acupressure rings are provided and may comprise raised areas on either side of spine align belt which create acupressure effects on the paraspinal muscles increasing blood flow, releasing built up muscle wastes and releasing natural painkillers and sedatives from the central nervous system. Decreased pain, improved flexibility and enhanced athletic performance may result from this.

(3) The specific beveled design of at least some, preferably most, acupressure nibs may penetrate and separate tight muscle and connective tissue with minimum pain creating deeper release and improved muscular flexibility.

(4) The spinal mobilizer aspect of the device of the invention (which may be located on about of the bilateral acupressure rings, but any preferable number of these may be used depending on the circumstances) is specifically contoured to sequentially apply downward pressure to unilateral transverse processes of vertebrae which may create a mobilizing effect as the user rolls his spine over the area. The resultant mobilizing effect on the vertebrae may improve joint motion reducing pain and improving mobility and performance.

(5) The heatability of the device preferably enables the user to increase blood flow, flushing out built up muscle wastes, reducing pain, expanding contracted connective and muscle tissue and improving lymph flow. The device of the invention may be placed in a microwave for, as an example, 60 seconds, or boiled for, as an example, 12 minutes, to produce, in one embodiment of the invention, about 40 to 60 minutes of heat. The device of the invention may be filled with water, flax seed or other substances to create the heating medium. Thus, the device of the invention may be used at prevailing ambient temperatures, and need not be heated at all. In another application, the device of the invention may in fact be cooled, with cooling may be determined to be an appropriate therapeutic benefit.

DETAILED DESCRIPTION OF THE INVENTION

Reference is now made to the various drawings showing embodiments of the present invention.

Figure 1:
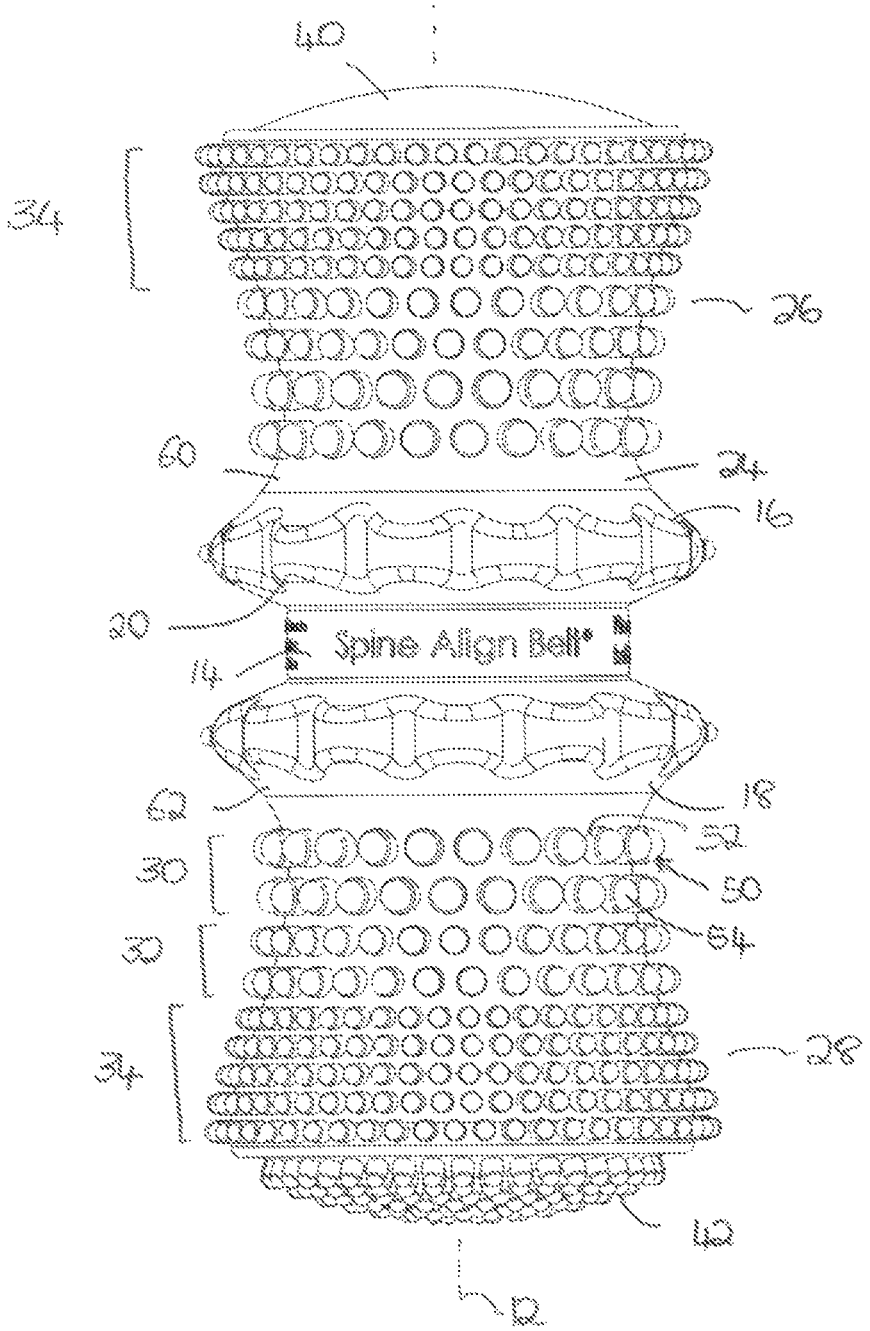
FIG. 1 is a back view of a device of the invention in accordance with one aspect thereof, showing the central spine groove, nibs and other contours of the heatable massage roller and posture aid of the invention.

In FIG. 1 of the drawings, there is shown a back view of a massage roller 10 in accordance with one aspect of the invention. The massage roller 10 is generally concentric about an axis 12 (see, for example, FIG. 4 of the drawings) and rotates about the axis 12 in use, as will be described below.

Figure 2:
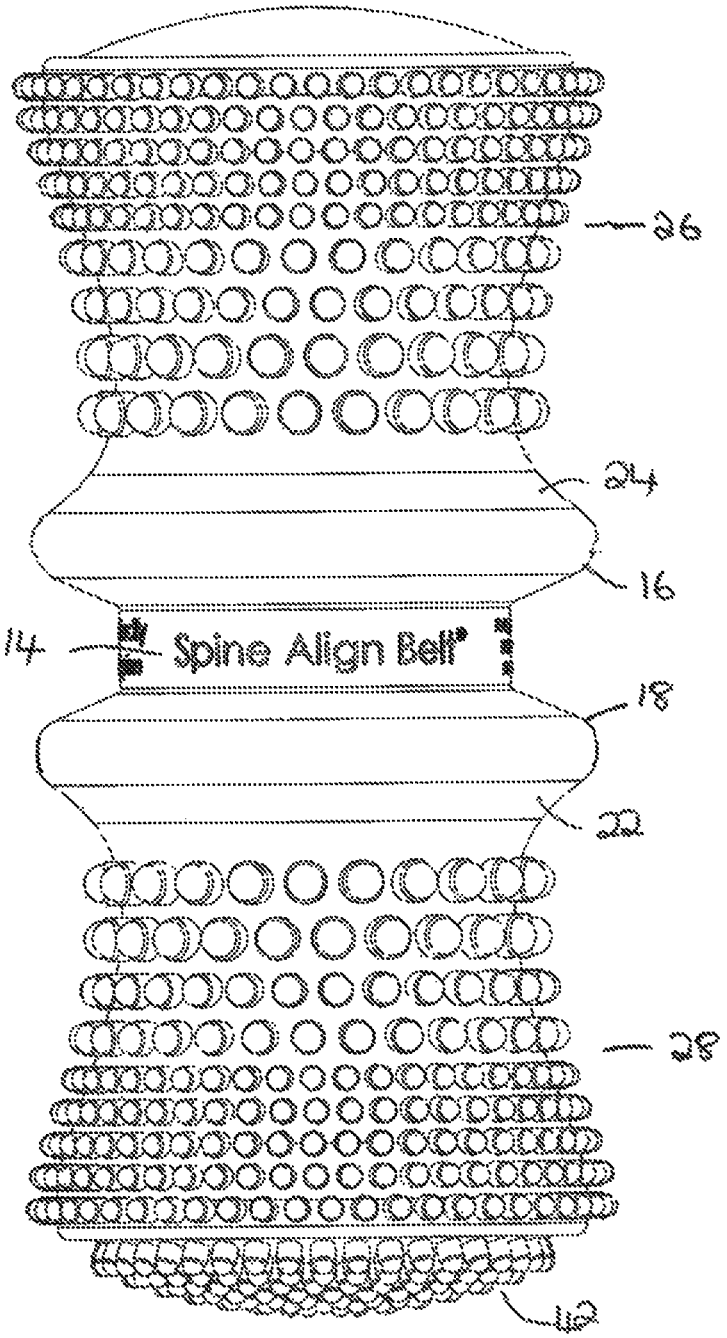
FIG. 2 is a front view of a device of the invention in accordance with one aspect thereof, showing the central spine groove, nibs and other contours of the heatable massage roller and posture aid of the invention.
Figure 3:
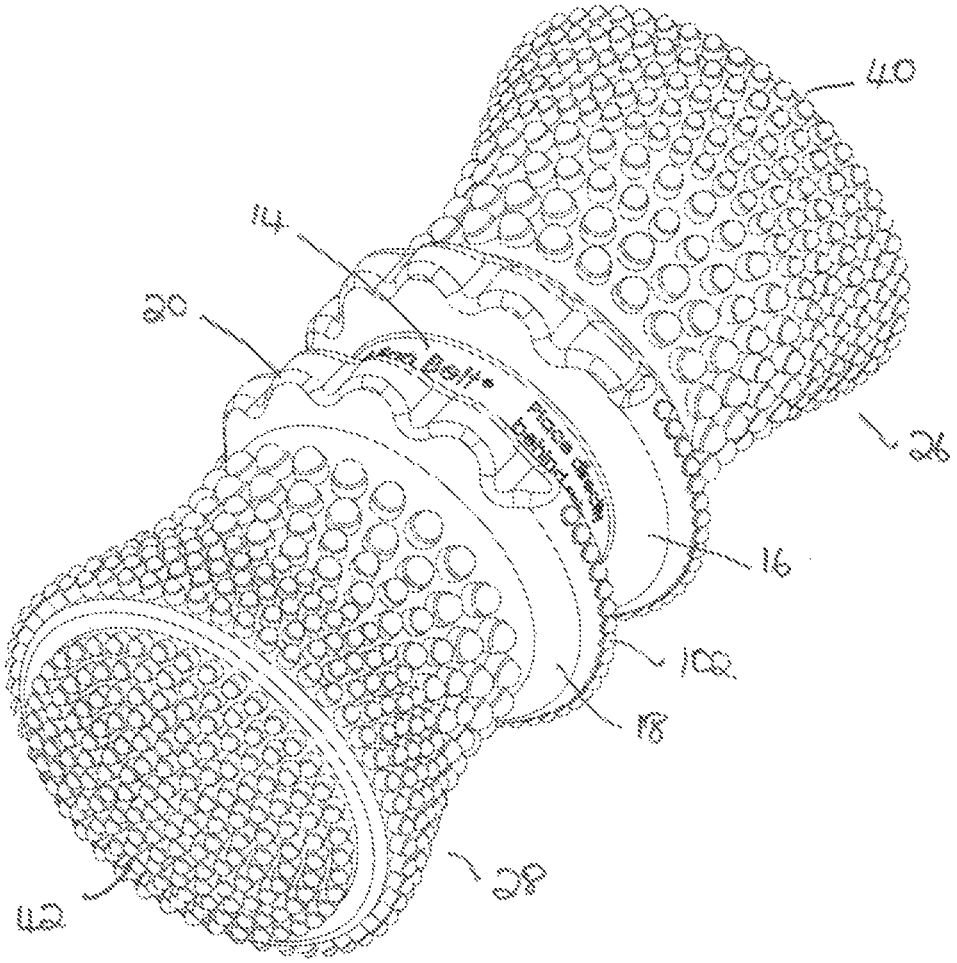
FIG. 3 is an isometric or perspective view of a device of the invention in accordance with one aspect thereof, showing the central spine groove, nibs and other contours of the heatable massage roller and posture aid of the invention.

The massage roller 10 has a central spinal groove 14 bordered on each side thereof by a circular wall 16 and 18. On the backside of the circular walls 16 and 18 there is a series of undulations 20, as seen in FIG. 1 of the drawings. From the front view, as illustrated in FIG. 2 of the drawings, the circular walls 16 and 18 are generally smooth, without the undulations 20. It will be seen that the circular walls 16 and 18 taper from a rounded narrow portion 22 to a wider base portion 24. The central spinal groove 14 is generally a flat band, as illustrated, but may also have contour and shape in other embodiments of the invention.

The massage roller 10 further comprises generally cylindrical outer portions 26 and 28 extending outwardly on each side of each of the circular walls 16 and 18. In the embodiment illustrated, the cylindrical outer portions 26 and 28 are not entirely cylindrical, but taper inwardly so that they are widest at or near their outermost point, and generally narrower at or near where they meet the circular walls 16 and 18. The cylindrical outer portions 26 and 28 each have a plurality of rows of ribs, each row of ribs being generally linearly and circumferentially arranged on the cylindrical outer portions 26 and 28.

In the embodiment shown in FIG. 1 of the drawings, there are two rows of ribs 30 of a larger dimension located near the circular walls 16 and 18 respectively. Adjacent the rows of larger ribs 30, there are a further two rows of ribs 32 of intermediate dimension, and adjacent the rows of ribs 32 of intermediate dimension, there are five rows of ribs 34 of smaller dimension. It must be appreciated that a particular massage roller 10 may have ribs formed thereon in any configuration or style, and of different sizes and contour, as may be selected. Therefore, the massage roller 10 of the invention should not in any way be construed as being limited with respect to the specific arrangement of ribs as they are illustrated in any one or more of the figures.

The massage roller 10 has end walls 40 and 42, which are slightly arcuate in shape. At least one of the end walls 40 and 42 has a sealable opening 44, to be described in further detail below. In some of the embodiments shown of the drawings, the end walls 40 and 42 are configured such that one end wall 40 has a generally smooth surface, while the other end wall 42 has a plurality of groups thereon. These ribs on the end wall 42 may be arranged concentrically, and maybe of one particular size and shape, or the ribs may have multiple sizes and shapes. Further, it should be noted that the invention is for a massage roller 10 where both of the end walls are generally smooth, or both of the end walls are generally ribbed. The number of ribs on an end wall may vary, and anyone of the end walls may have both smooth portions and ribbed portions.

Each rib 50 may be sized, contoured and configured to provide different massage rollers 10 in accordance with the invention. As one example only, a rib 50 may comprise a base portion 52 and a round portion 54, as many of the ribs 50 in the figures will show. However, the invention is not limited to a rib of such a configuration, and variations in structure, form and size are fully within the scope of the present invention. Thus, ribs may be generally hemispherical shape, ovoid, cylindrical, to provide some examples of the scope of the invention only.

Some areas on the outer portions 26 and 28 may be without ribs, such as smooth areas 60 and 62. Further, these smooth areas may be located on the outer portions 26 and 28 so that they are completely surrounded by ribs, which may be of different size or shape.

Figure 4:
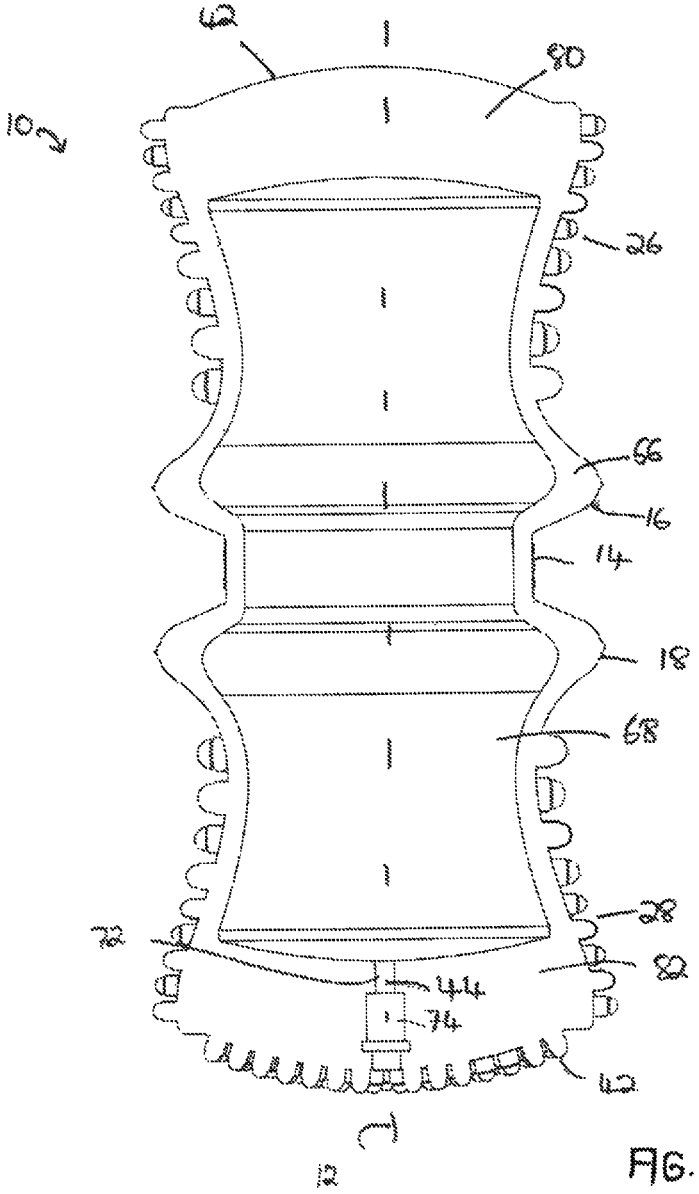
FIG. 4 is a cross section through a device of the invention in accordance with one aspect thereof, showing the central spine groove, nibs and other contours of the heatable massage roller and posture aid of the invention on the outer surface thereof, and a hollow space in the interior which may receive and contain a substance which can be heated.

FIG. 4 of the drawings shows a cross-section through a massage roller 10 of one embodiment of the invention. From this drawing, it will be seen that the massage roller 10 comprises an outer layer 66 formed of the various parts and elements discussed above, the outer layer 66 defining a cavity 68. The cavity 68 may be a single continuous cavity as shown in FIG. 4 of the drawings, or it may be a pair of cavities formed generally on each side of the central spinal groove 14. The opening 44 is shown in FIG. 4 of the drawings as being formed in the end wall 42, but the opening may also be in the end wall 40, or, indeed, in both of the end walls 40 and 42. The single or the multiple openings 44 communicate with a channel 72 which provides access to the cavity 68. In this way, desired material or materials as discussed herein may be introduced into and removed from the cavity 68, or the plurality of cavities if these are present, through the opening 44 and associated channels. The opening 44 is of course closable by means of a plug 74 or other device which can be inserted and removed. Any form of closure of the channel 72 may be provided to achieve this purpose. The plug 74 illustrated in FIG. 4 of the drawings is inserted at the opening of the channel 72, which may have a wider portion near its end so as to accommodate a plug of slightly larger dimension, which may assist in the ease with which the plug 74 may be inserted or removed.

With reference to FIG. 4 of the drawings, it will be seen that each end wall 40 and 42 has an added thickness or and internal projection or reinforcement section 80 and 82. The channel 72 extends through this reinforcement section 80 and 82 (when channels are present at both ends of the massage roller 10) which gives additional strength and support to the end walls 40 and 42 and the channel 72 running through them, so as to provide more resilience and endurance for inserting and removing any material into the cavity 68.

Figure 5:
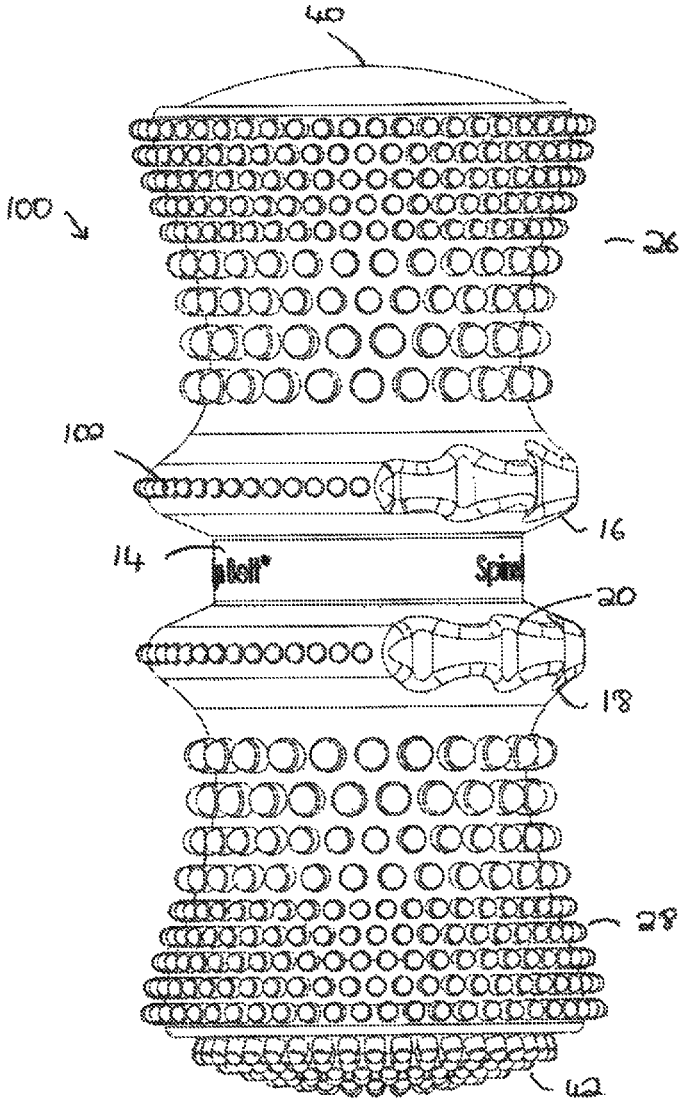
FIG. 5 is a top view of a device of the invention in accordance with one aspect thereof, showing the central spine groove, nibs and other contours of the heatable massage roller and posture aid of the invention.
Figure 6:
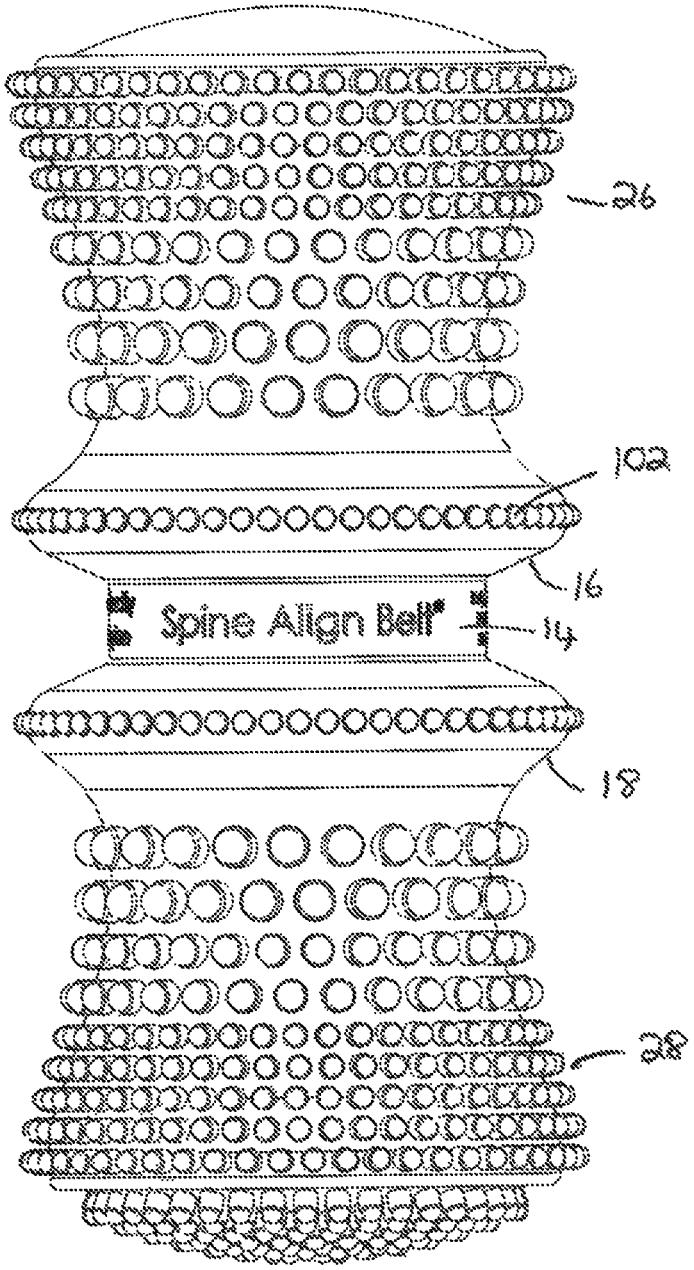
FIG. 6 is a further view of a device of the invention in accordance with one aspect thereof, showing the central spine groove, nibs and other contours of the heatable massage roller and posture aid of the invention.

FIG. 5 of the drawings shows a massage roller 100 in accordance with a further embodiment of the invention. This massage roller 100 is in many respects very similar to that described in the previous figures. The massage roller 100 includes a line or row of projections 102 along one side of the circular walls 16 and 18, which in a previous embodiment was generally of smooth texture. FIG. 6 shows a slightly rotated massage roller 100 including projections 102. These projections 102 are preferably located at the apex or top of the circular walls 16 and 18 so as to provide additional but optional therapeutic structure on the massage roller 100 as they traverse the back on either side of the spine, and embodiment which may be beneficial in certain contexts or applications.

Figure 7:
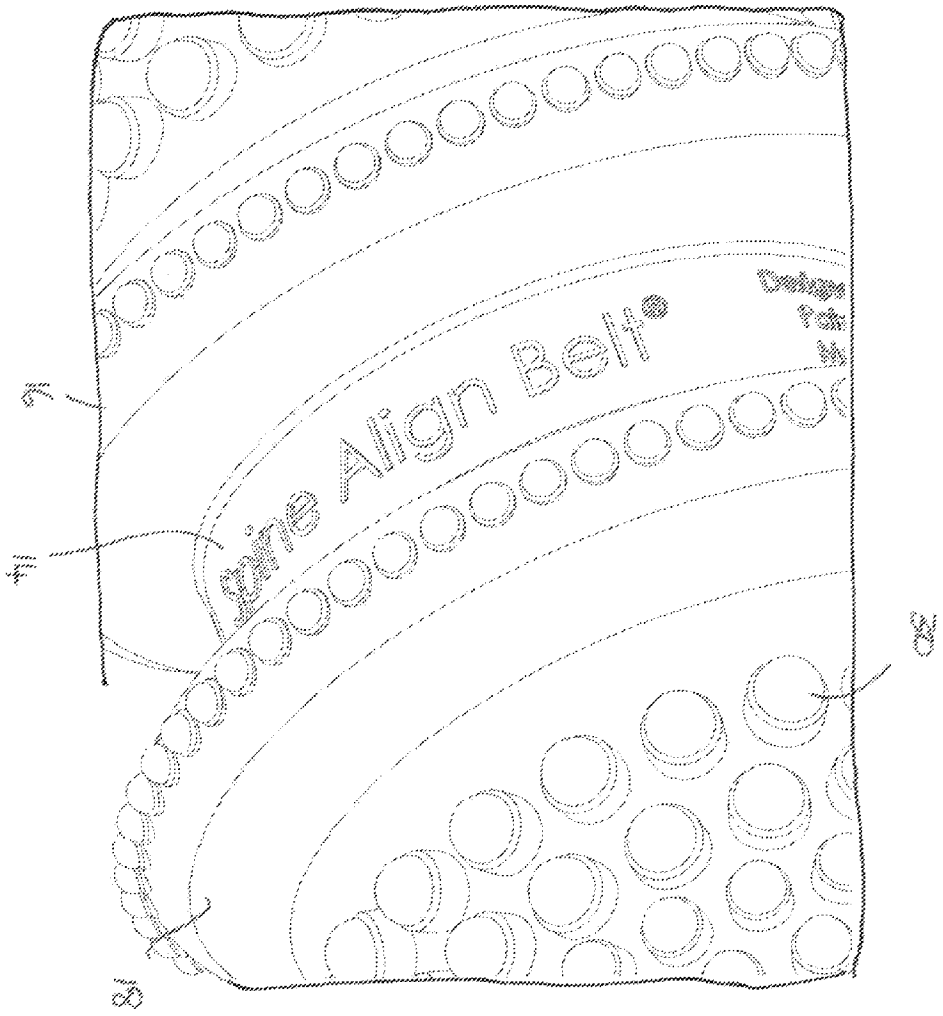
FIG. 7 is a detail view of a device of the invention in accordance with one aspect thereof, showing detailed features of the nibs and arrangement thereof.
Figure 8:
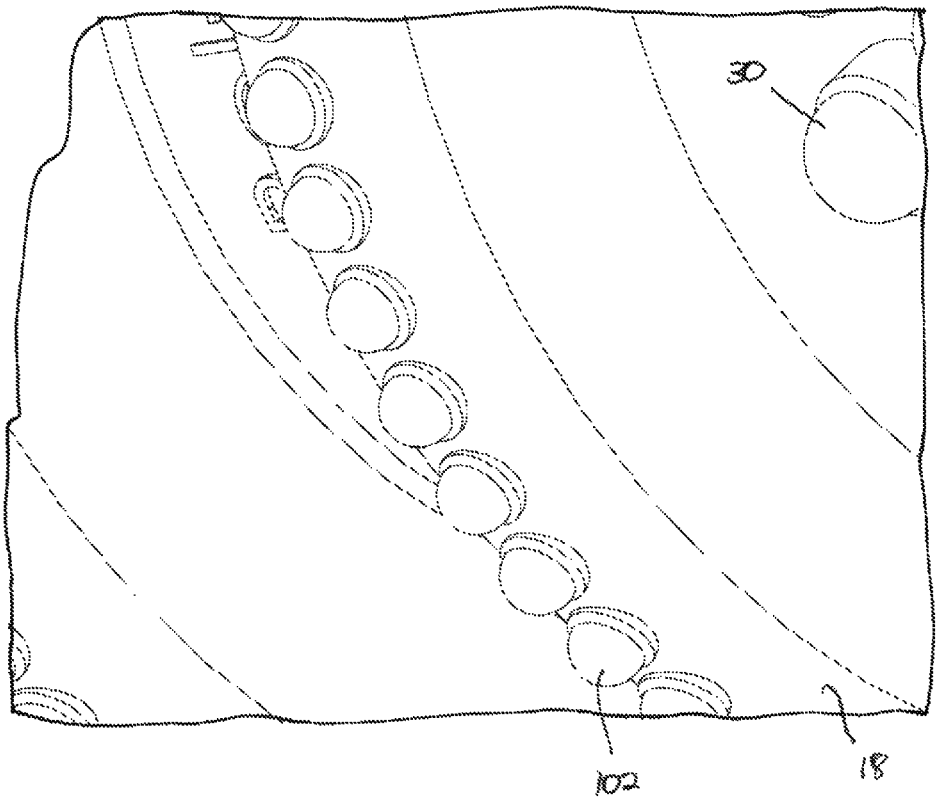
FIG. 8 is a further detail view of a device of the invention in accordance with one aspect thereof, showing detailed features of the nibs and arrangement thereof.

FIGS. 7 and 8 of the drawings show more detailed illustrations of the structure of the massage roller of the invention, including detailed views of some of the ribs and projections on the surface of the massage roller, including their contours and configuration. FIG. 7 illustrates the central area of the massage roller including the defined recess 14 intended to receive the spine of the user, as well as the ribs 102 mounted at the top or outer edge of the ribs 102. FIG. 7 also illustrates more clearly the different size and configuration of ribs that may be used, highlighting the smaller rib on the circular walls 16 and 18, and the slightly larger ribs which are located near the circular walls 16 and 18 on the outer portions 26 and 28.

FIG. 8 of the drawings shows an even more enlarged and detailed section of the massage roller of the invention, showing several of the smaller ribs on the circular outer wall, and most of a larger rib located on the outer portion of the massage roller.

As mentioned above, the outer portions 26 and 28 may be referred to as generally cylindrical in shape. However, a preferred aspect of the invention is that these outer portions 26 and 28 are not in fact completely cylindrical, but extend outwardly from a generally narrower portion adjacent the circular walls 16 and 18 to a slightly flared or expanded outer end near the end walls 40 and 42. Preferably, the narrower parts or sections of the outer portions 26 and 28 have a diameter which is substantially the same as the central spinal groove 14, although it may be just slightly smaller or slightly larger in diameter from one embodiment of the invention to another. The flared or out of part of the outer portions 26 and 28 have a diameter which is larger then the central spinal groove 14, and may approximate the diameter of the circular walls 16 and 18. The structure may, at least in certain applications of the massage roller of the invention, be advantageous in that the outer portions 26 and 28, by virtue of their somewhat increased diameter, make better contact with the back on each side of the spine, bearing in mind the natural contours of the human back.

The invention thus comprises a massage roller comprising an outer surface defining a cavity, the outer surface being contoured and configured so as to define a spinal groove, circular walls formed on each side of the spinal groove, outer portions extending from each of the circular walls outwardly therefrom, the outer portions having a plurality of ribs located thereon, and an end wall at the end of the outer portions on the side thereof remote from the circular walls. Preferably, the outer portions extend outwardly from the circular walls such that the diameter thereof gradually increases towards the end thereof, and that the diameters of the outer portions are substantially the same as and exceed the diameter of the spinal groove as the outer portion extends away from the spinal groove.

Preferably, the spinal groove is substantially centrally located along the massage roller and together with the circular walls forms a spinal channel in which the spine of the user may be accommodated. The circular walls have a wide base portion and taper towards their remote outer ends or apexes which are somewhat rounded. The outer edge of the circular walls may have a series of alternating humps and projections along at least a portion of the outer edge of the circular wall. That part of the outer edge of the circular wall without humps and projections may simply be smooth, or they may be some other type of configuration, such as a series of small linearly arranged protrusions. These protrusions or ribs may themselves be all they single size only, or ribs of multiple size and configuration may be arranged around the outer edge of the circular walls.

The outer portions extending from the circular walls are, in a preferred embodiment of the invention, narrowest along the line at or near where the outer portions meet the circular walls, and increase in diameter, albeit to a small extent in a preferred embodiment, as the outer portion approaches the end wall. The extent to which the diameter of the outer portions increase at a distance thereof remote from the circular walls can vary in different embodiments of the invention. The increased need not be linear. Thus, the increase in diameter may be mild or small near the circular wall, but get greater as the distance from the circular wall increases. Of course, a steady and linear increase in diameter may also be provided within the scope of the present invention.

Moreover, it is possible that the outer wall may even have a slight decrease in its diameter toward the end thereof at the point where it becomes the end wall 40 or 42. However, for the most part, the outer portion will at all times have a diameter which exceeds that of the central spinal belt portion.

In one preferred embodiment, the plurality of ribs are arranged in circular rows, each row extending outwardly from the circular wall. Each row of ribs may be comprised of ribs of the same general format, and different rows may have ribs of different size and configuration. However, the invention is not to be so limited, and any arrangement of ribs may be provided.

In one embodiment, one or both of the in walls has an inwardly extending reinforcement portion, which may have a channel and opening to provide access for inserting and removing materials from the cavity.

The massage roller may comprise a single cavity. In another embodiment, the massage roller may have two cavities, and these may correspond to one under each of the side cavities located beneath the circular wall and outer portion of the massage roller. In yet further embodiments, more than two cavities may be provided, and each may have its own access opening for inserting and removing material. The material in each one of the cavities, where there is more than one cavity, need not be the same. The material may be any combination as described above, or it may simply comprise air. The material may be heated or unheated depending upon the requirements in any particular circumstance or application.

The outer surface will have a specified thickness, and this may be varied, both with respect to any particular massage roller, as well as with respect to different parts of the outer surface on a specific massage roller.

The invention also relates to a method of treatment of the human body using the massage roller of the invention. A further aspect of the invention relates to the method of making a massage roller in accordance with the invention.

The invention is not to be construed as limiting to the embodiments and illustrations as seen in the drawings. Variations in the dimensions of the massage roller itself, as well as the different components of which it is comprised, fall within the scope of the invention.

The invention claimed is:

1. A massage roller comprising:

a central spinal recess portion;

a circular wall portion on each side of the spinal recess portion;

an outer portion extending outwardly from each of the circular wall portions, the outer portion having a first diameter at or near the circular wall portion, and a second diameter remote from the circular wall portion, the second diameter being larger than the first diameter; and a plurality of rows of circumferential linearly arranged protrusions formed on the outer portion, including a first set of protrusions of relatively larger size and diameter adjacent the circular wall portion, a second set of protrusions of relatively smaller size and diameter remote from the circular wall portion, and a third set of protrusions of intermediate size and diameter between the first set of protrusions and the second set of protrusions.

2. A massage roller as claimed in claim 1 wherein the central spinal recess portion has a diameter which is substantially the same as the first diameter of the outer portion.

3. A massage roller as claimed in claim 1 wherein the central spinal recess portion generally comprises a flat band of circular shape.

4. A massage roller as claimed in claim 1 wherein the circular wall portion comprises a wider base portion tapering towards a rounded top portion.

5. A massage roller as claimed in claim 1 wherein the circular wall portion comprises a series of contoured humps along at least a portion thereof.

6. A massage roller as claimed in claim 1 wherein the circular wall portion comprises a series of linearly arranged protrusions along at least a portion thereof.

7. A massage roller as claimed in claim 1 comprising a hollow cavity formed therein, the hollow cavity having an outlet channel and a plug for selectively sealing and opening access to the hollow cavity.

8. A massage roller as claimed in claim 7 further comprising a fill material located in the hollow cavity thereof.

9. A massage roller as claimed in claim 1 further comprising an end portion at each of the ends of the outer portions.

10. A massage roller as claimed in claim 9 wherein at least one of the end portions has a plurality of protrusions or ribs formed thereon.

11. A massage roller as claimed in claim 1 wherein the outer portion at or near the end thereof remote from the circular wall has a diameter which is substantially the same as the diameter of the outer wall.

* * * * *